United States Patent [19]

Sheldon

[11] 4,059,371

[45] Nov. 22, 1977

[54] ROTARY ENGINE STATIONARY GEAR LOCATING AND TIMING DEVICE

[75] Inventor: John D. Sheldon, Zion, Ill.

[73] Assignee: Outboard Marine Corporation, Waukegan, Ill.

[21] Appl. No.: 614,531

[22] Filed: Sept. 18, 1975

[51] Int. Cl.[2] ..... F04C 1/02; F16H 1/10; F16H 1/32; F16H 57/02

[52] U.S. Cl. ..... 418/61 A; 74/413; 74/804; 418/270

[58] Field of Search ..... 418/60, 61 A, 270; 123/8.01, 8.45; 74/413, 804, 710; 403/359, 365; 182/114 T

[56] References Cited

U.S. PATENT DOCUMENTS

| | | | |
|---|---|---|---|
| 2,630,025 | 3/1953 | Lapsley | 74/773 X |
| 3,193,187 | 6/1965 | Jones et al. | 418/60 |
| 3,289,647 | 12/1966 | Turner et al. | 418/61 A |
| 3,465,729 | 9/1969 | Jones | 418/61 A |
| 3,947,159 | 3/1976 | Myleneck | 418/60 |

FOREIGN PATENT DOCUMENTS

| | | | |
|---|---|---|---|
| 1,317,151 | 12/1962 | France | 74/804 |

*Primary Examiner*—Carlton R. Croyle
*Assistant Examiner*—Leonard Smith
*Attorney, Agent, or Firm*—Michael, Best & Friedrich

[57] ABSTRACT

Disclosed herein is a rotary piston engine comprising a housing assembly including a trochoid housing and a pair of end housings aligned and secured together to define a trochoid cavity, a shaft rotatably supported in the end housings and having an eccentric portion disposed in the trochoid cavity, a rotary piston rotatably supported on the eccentric portion of the shaft and extending within the trochoid cavity, the rotary piston having an internal timing gear, a stationary gear separate from the end housings and in mesh with the internal timing gear, a female member extending integrally from one of the end housings and being disposed adjacent to the trochoid housing, the female member having a registering surface in predetermined fixed relation relative to the end housing, and a male member extending integrally from the stationary gear, the male member being pressed into the female member and held in non-rotatable relation by the registering surface.

4 Claims, 2 Drawing Figures

ROTARY ENGINE STATIONARY GEAR LOCATING AND TIMING DEVICE

BACKGROUND OF THE INVENTION

The invention relates generally to rotary piston engines and more particularly to a stationary gear locating and timing device.

Prior art practice requires very accurate machining of a dowel hole in a stationary gear and a corresponding end housing so that when assembled, the angular and radial location of the stationary gear is accurate relative to the end housing. The stationary gear is then retained axially by a series of bolts. The positioning of the stationary gear in predetermining fixed relation relative to the end housing is important as this maintains the timing relationship between the rotary piston and the trochoid housing.

SUMMARY OF THE INVENTION

The invention provides a rotary piston engine comprising a housing assembly including a trochoid housing having means at least partially defining a trochoid cavity, a pair of end housings, means for aligning and securing together the end housings and the trochoid housing to further define the trochoid cavity, a shaft rotatably supported in the end housing and having an eccentric portion disposed within the trochoid cavity, a rotary piston rotatably supported on the eccentric portion of the shaft and extending within the trochoid cavity, the rotary piston having an internal timing gear, a stationary gear separate from the end housing and in mesh with the internal timing gear, and mutually interfitting means extending integrally from each of the stationary gear and one of the end housings for mounting the stationary gear in predetermined fixed relation to one of the end housings.

In accordance with an embodiment of the invention, the mutually interfitting means comprises a female member extending integrally from one of the end housings and being disposed adjacent to the trochoid housing, the female member having a registering surface in predetermined fixed relation relative to the trochoid housing, and a male member extending integrally from the stationary gear, the male member being pressed into the female member and held in non-rotatable relation by the registering surface.

Also in accordance with an embodiment of the invention, the invention provides a rotary piston engine comprising a housing assembly including a trochoid housing having means at least partially defining a trochoid cavity, a first end housing having a shaft opening with an internal gear disposed adjacent the trochoid housing, the internal gear being in predetermined fixed relation relative to the first end housing, and a second end housing, means for aligning and securing together the end housings and the trochoid housing to further define the trochoid cavity, a stationary gear pressed into the internal gear, the stationary gear having a first end projecting through the internal gear into the adjacent trochoid cavity, a shaft rotatably supported in the end housings and having an eccentric portion disposed within the trochoid cavity, a rotary piston rotatably supported on the eccentric portion of the shaft and extending within the trochoid cavity, the rotary piston having an internal timing gear disposed adjacent to the first end housing and being in mesh engagement with the projecting first end of the stationary gear.

Still further in accordance with an embodiment of the invention, the first end housing has a bearing positioned outwardly of the internal gear, and the stationary gear has a second end with an outwardly extending flange locked between the bearing and internal gear.

Still further in accordance with an embodiment of the invention, the invention provides a rotary piston engine wherein an internal gear is machined within the shaft opening of an end housing, the internal gear being in predetermined fixed relation with respect to the end housing.

One of the principal features of the invention is the provision of a rotary piston engine including mutually interfitting means extending integrally from each of the stationary gear and one of the end housings for mounting the stationary gear in predetermined fixed relation to one of the end housings.

Anoher principal feature of the invention is the provision of a rotary piston engine including a first end housing having a shaft opening with an internal gear disposed adjacent to a trochoid housing, the internal gear being in predetermined fixed relation relative to the first end housing, and a stationary gear pressed into the internal gear, the stationary gear also being in predetermined fixed relation relative to the first end housing and having a first end projecting through the internal gear, the first end being in mesh with an internal timing gear of a rotary piston within the adjacent trochoid cavity.

Another principal feature of the invention is the provision of a rotary piston engine including a first end housing with a shaft opening having a bearing positioned outwardly of an internal gear and a stationary gear pressed into the internal gear, the stationary gear having a second end with an outwardly extending flange locked between the bearing and the internal gear to prevent axial movement.

Other features and advantages of the embodiments of the invention will become known by reference to the following general description, appended claims, and drawings.

DRAWINGS

Figure 2:
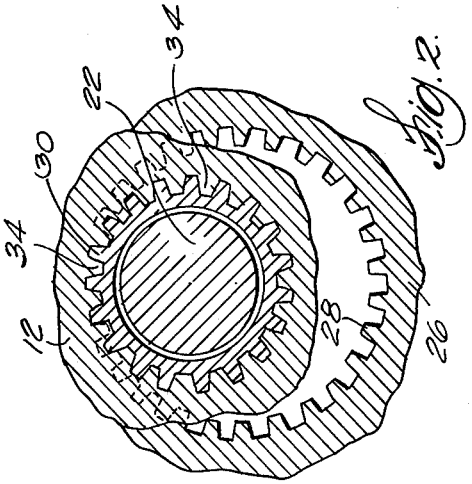
FIG. 2 is a fragmentary section view taken along lines 2—2 in FIG. 1.
Figure 1:
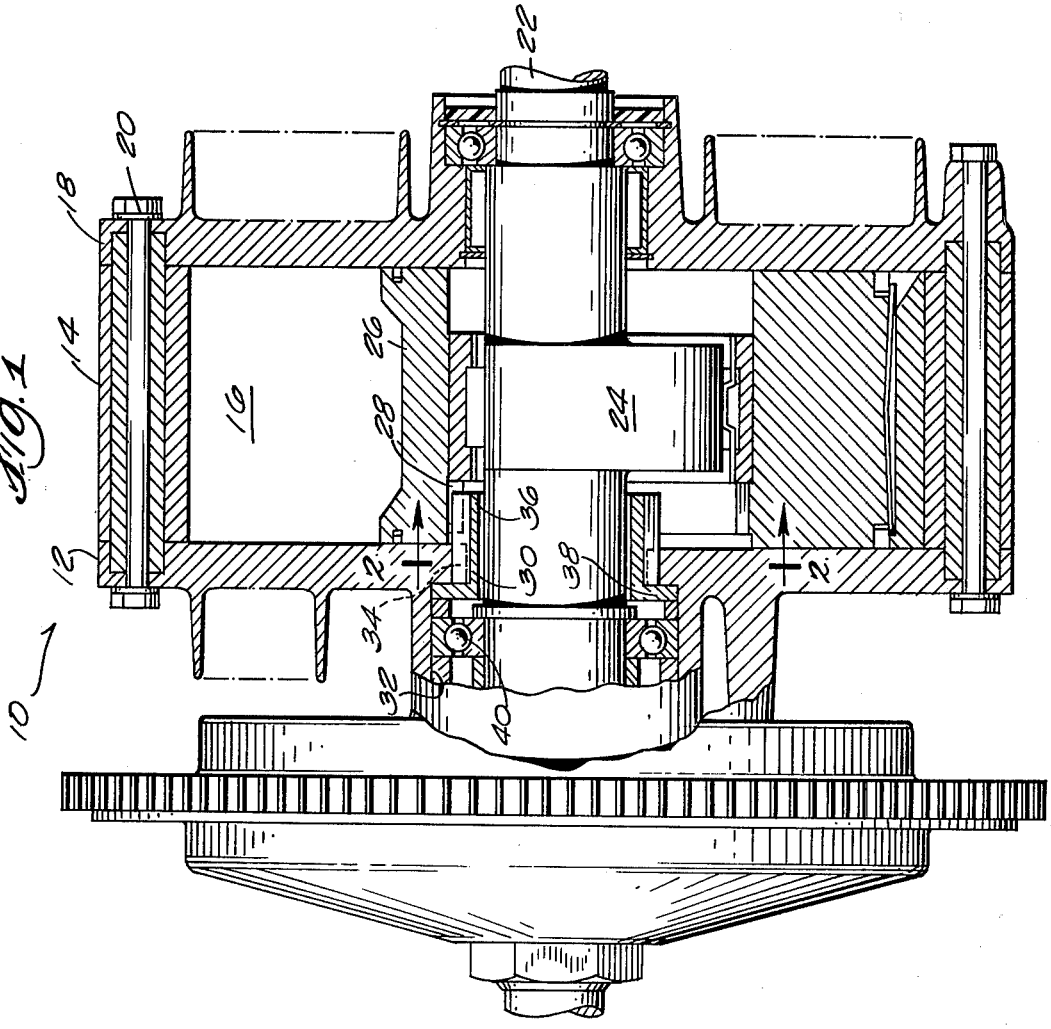
FIG. 1 is a sectional view of a rotary piston engine incorporating various of the features of the invention.

Before explaining the embodiments of the invention in detail, it is to be understood that the invention is not limited in its application to the details of construction and the arrangement of components set forth in the following description or illustrated in the drawings. The invention is capable of other embodiments and of being practiced and being carried out in various ways. Also, it is to be understood that phraseology and terminology employed herein is for the purpose of description and should not be regarded as limiting.

GENERAL DESCRIPTION

Shown in the drawings is a rotary piston engine 10 which includes a first end housing 12, a trochoid housing 14 having means partially defining a trochoid cavity 16 and a second end housing 18. Means are provided for aligning and securing together the first end housing 12, the trochoid housing 14 and the second end housing 18 to further define the trochoid cavity 16. Various conventional arrangements can be employed and in the illustrated construction, such means comprises bolts 20 passing through mutually aligned holes in the trochoid housing and end housings of the housing assembly.

A shaft 22 is rotatably supported in the end housings 12 and 18. The shaft 22 has an eccentric portion 24 diposed within the trochoid cavity 16. A rotary piston 26 is rotatably supported on the eccentric portion 24 and extends within the trochoid cavity 16. The rotary piston 26 has an internal timing gear 28 located adjacent to the first end housing 12. A stationary gear 30 extends separate from the end housing and is in mesh with the internal timing gear 28 as will be explained in more detail below.

Mutually interfitting means extend integrally from each of the stationary gear and one of the end housings for mounting the stationary gear in predetermined fixed relation to the end housing. Various arrangements can be employed and in the illustrated construction one of the end housings includes a female member disposed adjacent to the trochoid housing, the female member having a registering surface in predetermined fixed relation relative to the end housing. The stationary gear includes a male member portion pressed into the female member and held in non-rotatable relation by the registering surface.

More specifically, the first end housing 12 has a shaft opening 32 with a female member, an internal gear 34, machined in predetermined fixed relation relative to the first end housing 12. The stationary gear 30 is pressed through the registering surface or teeth of the internal gear 34 and is held in non-rotatable relation. The stationary gear 30 is thus also held in predetermined fixed relation relative to the first end housing. The stationary gear 30 has a first end 36 projecting into the trochoid cavity 16 and has a second end with an outwardly extending flange 38. The shaft opening 32 has a bearing 40 which rotatably supports a portion of the shaft 22 and locks the outwardly extending flange 38 of the stationary gear 30 against the internal gear 34 thus preventing axial movement of the stationary gear 30.

It is to be particularly understood that the internal gear 34 of the first end housing 12 is machined within the shaft opening 32 so that it is accurately positioned in predetermined fixed relation relative to the first end housing. When the stationary gear 30 is pressed into the matching internal gear 34 it is held in non-rotatable relation and thus it too is accurately positioned in predetermined fixed relation relative to the first end housing 12. Since the trochoid housing 14 and the second end housing 18 are mutually aligned and secured to the first end housing 12, the stationary gear 30 and its first end 36 projecting into the trochoid cavity 16 are accurately positioned in predetermined fixed relation relative to the trochoid housing 14 as well as relative to the first end housing 12. Thus, the rotary piston 26, with its internal timing gear 28 in mesh with the first end 36 of the stationary gear, will be accurately timed with respect to the trochoid housing 14.

Various features of the invention are set forth in the following claims:

What is claimed is:

1. A rotary piston engine comprising a housing assembly including a trochoid housing having means at least partially defining a trochoid cavity, a pair of end housings, means for aligning and securing together said end housings and said trochoid housing to further define the trochoid cavity, a shaft rotatably supported in said end housings and having an eccentric portion disposed within the trochoid cavity, a rotary piston rotatably supported on said eccentric portion of said shaft and extending within the trochoid cavity, said rotary piston having an internal timing gear, a stationary gear separate from said end housings and having teeth in mesh with said internal timing gear, and means extending from one of said end housings in interfitting relation with said teeth of said stationary gear for mounting said stationary gear in predetermined fixed relation to said one of said end housings.

2. A rotary piston engine in accordance with claim 1 wherein said means for mounting said stationary gear comprises internal gear teeth extending integrally from one of said end housings, in predetermined fixed relation relative to said housing assembly, and said teeth of said stationary gear being in mesh with said gear teeth of said one end housing to prevent relative rotation therebetween.

3. A rotary piston engine comprising a housing assembly including a trochoid housing having means at least partially defining a trochoid cavity, a first end housing having a shaft opening and having therein an internal gear having teeth, and a second end housing, means for aligning and securing together said end housings and said trochoid housing to further define the trochoid cavity, a stationary gear having teeth pressed into said teeth of said internal gear, said teeth of said stationary gear projecting into the adjacent trochoid cavity, a shaft rotatably supported in said end housings and having an eccentric portion disposed within the trochoid cavity, a rotary piston rotatably supported on said eccentric portion of said shaft and extending within the trochoid cavity, said rotary piston having an internal timing gear disposed adjacent said first end housing and having teeth in meshed engagement with said projecting teeth of said stationary gear.

4. A rotary piston engine comprising a housing assembly including a trochoid housing having means at least partially defining a trochoid cavity, a first end housing having a shaft opening, an internal gear disposed adjacent said trochoid housing, said internal gear being in predetermined fixed relation relative to said first end housing, and a bearing positioned outwardly of said internal gear, and a second end housing, means for aligning and securing together said end housings and said trochoid housing to further define the trochoid cavity, a stationary gear pressed into said internal gear and held in non-rotatable relation, said stationary gear being in predetermined fixed relation relative to said first end housing and having a first end projecting through said internal gear into the adjacent trochoid cavity, and a second end with an outwardly extending flange locked between said bearing and said internal gear, a shaft rotatably supported in said end housings and having an eccentric portion disposed within the trochoid cavity, a rotary piston rotatably supported on said eccentric portion of said shaft and extending within the trochoid cavity, said rotary piston having an internal timing gear disposed adjacent said first end housing and being in meshed engagement with said projecting first end of said stationary gear.

* * * * *